US005480586A

United States Patent [19]

Jakubicki et al.

[11] Patent Number: 5,480,586

[45] Date of Patent: Jan. 2, 1996

[54] LIGHT DUTY LIQUID DETERGENT COMPOSTION COMPRISING A SULFOSUCCINAMATE-CONTAINING SURFACTANT BLEND

[75] Inventors: Gary Jakubicki, Robbinsville; Elizabeth F. McCandish, Highland Park, both of N.J.

[73] Assignee: Colgate-Palmolive Co., Piscataway, N.J.

[21] Appl. No.: 314,399

[22] Filed: Sep. 26, 1994

Related U.S. Application Data

[63] Continuation-in-part of Ser. No. 231,356, Apr. 22, 1994, which is a continuation-in-part of Ser. No. 854,048, Mar. 18, 1992, abandoned, which is a continuation-in-part of Ser. No. 685,118, Apr. 15, 1991, abandoned.

[51] Int. Cl.[6] ..... C11D 1/28; C11D 1/83; C11D 3/22; C11D 3/48

[52] U.S. Cl. ..... 252/545; 252/106; 252/173; 252/174.17; 252/544; 252/546; 252/548; 252/551; 252/553; 252/557; 252/559; 252/DIG. 14

[58] Field of Search ..... 252/174.17, 173, 252/557, 525, 526, 527, 544, 545, 546, 548, 551, 553, 559, DIG. 14, 106, 107

[56] References Cited

U.S. PATENT DOCUMENTS

| | | | |
|---|---|---|---|
| 3,963,649 | 6/1976 | Spadini et al. | 252/546 |
| 4,040,989 | 8/1977 | Renaud et al. | 252/548 |
| 4,133,779 | 1/1979 | Hellyer et al. | 252/547 |
| 4,175,062 | 11/1979 | Disch et al. | 252/540 |
| 4,235,758 | 11/1980 | Dawson et al. | 252/544 |
| 4,272,395 | 6/1981 | Wright | 252/106 |
| 4,316,824 | 2/1982 | Pancheri | 252/551 |
| 4,333,862 | 6/1981 | Smith et al. | 252/547 |
| 4,396,520 | 8/1983 | Payne et al. | 252/89.1 |
| 4,435,317 | 3/1984 | Gerritsen et al. | 252/547 |
| 4,483,787 | 11/1984 | Jones et al. | 252/551 |
| 4,536,318 | 8/1985 | Cook et al. | 252/174.17 |
| 4,556,509 | 12/1985 | Demangeon et al. | 252/542 |
| 4,565,647 | 1/1986 | Llenado | 252/354 |
| 4,569,782 | 2/1986 | Disch et al. | 252/106 |
| 4,595,526 | 6/1986 | Lai | 252/545 |
| 4,599,188 | 7/1986 | Llenado | 252/174.17 |
| 4,659,497 | 4/1987 | Akred et al. | 252/135 |
| 4,663,069 | 5/1987 | Llenado | 252/117 |
| 4,668,422 | 5/1987 | Malik et al. | 252/174.17 |
| 4,692,271 | 9/1987 | Messenger et al. | 252/DIG. 14 |
| 4,732,696 | 3/1988 | Urfer | 252/174.17 |
| 4,732,704 | 3/1988 | Biermann et al. | 252/548 |
| 4,790,856 | 12/1988 | Wixon | 8/137 |
| 4,839,098 | 6/1989 | Wisotzki et al. . | |
| 5,015,414 | 5/1991 | Kamegai et al. | 252/545 |
| 5,328,628 | 7/1994 | Hart et al. | 252/91 |

FOREIGN PATENT DOCUMENTS

| | | |
|---|---|---|
| 0421384 | 4/1991 | European Pat. Off. . |
| 9011411 | 5/1990 | WIPO . |

*Primary Examiner*—Paul Lieberman
*Assistant Examiner*—Ardith Hertzog
*Attorney, Agent, or Firm*—Richard E. Nanfeldt; Murray Grill; Robert C. Sullivan

[57] ABSTRACT

An aqueous liquid detergent composition for handwashing soiled dishware includes specific narrow classes and amounts of magnesium or sodium alkyl benzene sulfonate surfactant, alkyl ether sulfate surfactant, $C_{12}$–$C_{16}$ alkyl polyglucoside and alkanolamide foam stabilizer. A higher alkyl sulfosuccinate or sulfosuccinamate, optionally ethoxylated, anionic surfactant may also be present. The compositions are capable of generating a stable foam and are effective in cleaning greasy soils with acceptable mildness for the consumer with good rinseability.

6 Claims, No Drawings

LIGHT DUTY LIQUID DETERGENT COMPOSTION COMPRISING A SULFOSUCCINAMATE-CONTAINING SURFACTANT BLEND

This application is a continuation in part application of prior application, U.S. Serial No. 08/231,356 filed Apr. 22, 1994 which in turn is a continuation in part application of U.S. Serial No. 07/854,048 now abandoned filed on Mar. 18, 1992 which in turn is a continuation in part of prior application U.S. Serial No. 07/685,118 (now abandoned) filed Apr. 15, 1991.

BACKGROUND OF THE INVENTION

1. Field of the Invention

This invention relates to light duty liquid detergents having particular utility in the hand washing of dishware, including dishes, pots, pans, glassware and silverware/flatware. More particularly, it relates to a liquid dishwashing detergent composition which provides stable, persistent foaming characteristics combined with good rinseability, mildness to the skin and effectiveness in removing greasy soils from dishware.

2. Discussion of the Art and Problem Solved

Foam generation by detergent compositions is associated by the consumer with good detersive ability. However, it is apparent that long lasting foam, whether considered copious or medium to medium-low foam content is, by itself, not a sufficient measure of cleaning ability. Nevertheless, much effort has been extended to optimize foaming characteristics, without necessarily improving cleaning ability.

Greasy soils are generally considered to be one of the most difficult soil types to be removed by hand washing. Effective grease removal is nearly always associated with requiring high temperature water to help dissolve and remove the grease.

Clearly, there would be a great advantage to formulate a mild, foaming, liquid hand dishwashing composition, which is capable of and effective in removing greasy soils as well as other soil types from dishware using water at ambient or warm to high temperature.

It has been known that among the anionic surfactants, those based on magnesium as the counted or (i.e. cation) can improve grease cutting performance. However, grease cutting performance is generally associated with increased irritation to the skin, e.g. hands, of the consumer.

It has also been known to use generally milder types of surfactants to ameliorate the somewhat harsh effects of the magnesium based anionic surfactants. Alkyl polyglucoside (APG) nonionic surfactants have been suggested for this purpose. However, although providing some foaming characteristics, the APG type surfactant has generally poorer foaming performance than other conventional foaming surfactants.

Another important characteristic to the consumer for hand dishwashing formulations is the ability to easily wash away the copious foam which is associated with good cleaning performance. Surfactant systems providing APG generated foams are not always acceptable in terms of rinseability.

Accordingly, it is an object of this invention to provide hand dishwashing aqueous compositions which combine acceptable mildness, foaming and grease cleaning performance.

It is another object of the invention to provide such compositions with good foam rinseability.

The present invention provides compositions which avoid the elevated problems and accomplish the foregoing objectives. The compositions, although prepared from otherwise known ingredients, but in unique combinations and proportions, is capable of achieving a new and beneficial results.

SUMMARY OF THE INVENTION

In accordance with the present invention, the liquid dishwashing detergent composition comprises, as essential ingredients:

(a) a surfactant system comprising: (1) from about 7.5 to 20% of a $C_{10}$–$C_{16}$ alkyl benzene sulfonate anionic surfactant; (2) from 0 to 8% of an alkali metal salt of a monoalkyl $C_8$–$C_{18}$ sulfosuccinate or sulfosuccinamate anionic surfactant, wherein the alkyl group may be ethoxylated with up to about 8 moles of ethylene oxide; (3) from about 8 to about 20% of anionic $C_{12-C20}$ alkyl ether sulfate having from about 1 to less than 3 ethylene oxide groups, on average; and, (4) from about 3 to 12% of an alkyl glucoside having from 12 to 16 carbon atoms, on average, in the alkyl chain, and an average degree of polymerization in the range of from about 1 to 3; and (b) from about 0.5 to 6% of a foam stabilization system comprising at least one lower alkanolamide of higher alkanoic acid, and the balance water. The total actives (a) and (b) will usually range from about 25 to about 54% or more of the total composition.

Optional, but often beneficial adjuvants which can, and often are included in the composition include:

(c) a low irritant organic solvent, up to about 10%;

(d) hydrotrope, up to about 8%;

(e) other adjuvants, such as, chelating or sequestering agents, coloring agents, dyes, perfumes, bactericides, fungicides, preservatives, sunscreening agents, pH modifiers, pH buffering agents, opacifiers, antioxidants, thickeners, proteins, and the like, up to about 20%, in total, with a maximum of any individual component being about 10%.

Unless indicated otherwise all percents and percentages given herein are on a by weight basis.

The components of the invention compositions will now be described in greater detail.

DETAILED DESCRIPTION AND PREFERRED EMBODIMENTS

The present invention is based, in part, on the quite unexpected discovery that the foam stabilizing, foam boosting combination of the alkyl polyglucoside (APG) and alkanolamide components has a significant impact on the grease removal performance of the composition at a constant level of total surfactant/foam stabilization components. More specifically, it has now been found that while some enhanced grease removal benefits may be provided with the foam stabilizing alkanolamide alone, as compared to existing top of the line commercial products, the improvement in grease removal performance is further dramatically improved in the system containing both foam stabilizing alkanolamide and APG. Furthermore, by employing the alkyl ether sulfate (AEOS) with less than 3 moles ethylene oxide, e.g. AEOS-1EO or AEOS-2EO, a more copious foam can be obtained as compared to the same composition containing AEOS-3EO (i.e. 3 moles ethylene oxide) while still retaining acceptable mildness. Also, by employing low levels of the foam boosting alkanolamide component (b), in conjunction with the specified surfactant system (a), good rinseability of the dishware is achieved without impairing cleaning performance. For example, the assignee's previous commercially available liquid light duty hand washing producing, Liquid Palmolive® (17% NaLAS, 13% AEOS-3EO, 4% LMMEA, 3.3% SCS+SXS, 0.5% inorganic salts; balance perfume, color, ethanol, water), removed about 25 milligrams (mg), of greasy soil (lard) in a gravimetric grease removal test as compared to only 5 mg for the same formula with 0% LMMEA. However, in a composition according to this invention containing APG, grease removal increases by about 80 mg over the level of LMMEA between about 1% and about 4% by weight of the composition. These observations were based on surfactant systems in which the counterion of the anionic surfactant(s) was sodium. In systems in which magnesium salts of the anionic ABS surfactant are used, both the concentration of the Mg ion and the alkanolamide strongly influence grease removal. For example, when tested in the gravimetric grease soil removal test with a surfactant system containing 10 wt. % linear dodecyl benzene sulfonate (LAS)/12 wt. % fatty $C_{12}$–$C_{16}$ alcohol ethoxylate (1 mole ethylene oxide (1EO))/6 wt. % APG ($C_{12}$–$C_{16}$ alkyl; D.P.=1.6) the grease removal performance obtained at the Mg and LMMEA levels indicated in the following Table 1 were obtained.

TABLE 1

| Mg ion % | LMMEA % | Grease Removal, mg |
|---|---|---|
| 0.1 | 4 | 37 |
| 0.1 | 2 | 8 |
| 0.4 | 2 | 61 |
| 0.25 | 3 | 60 |
| 0.4 | 4 | 80 |

The components of the invention's compositions will now be described.

(A) The Surfactant System (1) The first essential surfactant ingredient is the anionic salt of an alkyl benzene sulfonic acid (ABS), preferably a linear $C_{10}$–$C_{16}$ alkyl benzene sulfonate (LAS).

Furthermore, when the magnesium salt is used, it may be, for example, a magnesium oxide neutralized linear dodecyl benzene sulfonic acid, or alternatively, the magnesium salt may be formed by adding an electrolyte magnesium salt, such as magnesium chloride, magnesium sulfate, etc. to sodium alkyl benzene sulfonate. In the latter alternative, an excess of the magnesium salt electrolyte could raise the cloud/clear point of the composition. This undesirable effect can, however, be compensated for by addition of hydrotrope, as described below.

The anionic surfactant (1) is present in an amount of from about 7.5% to about 20%, based on the total composition, or in an amount of from about 28 to 40%, based on the total surfactants (A)(1), (2), (3) and (4). The more preferred range of amounts of the anionic ABS salt surfactant is from about 8 to 12 or 15%, especially about 9 to 11%, e.g. about 10%, based on the total composition, or about 29 to 35%, especially about 30 to 33%, based on the sum of the surfactants (A)(1), (2), (3) and (4).

At below the 7.5% (total) level the improvement in low temperature grease removal becomes insufficient, while at amounts above 20% (total) the composition containing the magnesium salt tends to be mildly irritating to the hands.

The anionic ABS in the surfactant system may be in the form of the alkali metal or alkaline earth metal salts, or mixture thereof. The preferred alkali metals are sodium and potassium, preferably sodium. The preferred alkaline earth metals are calcium and magnesium preferably magnesium. The linear alkyl group preferably contains from 10 to 13 carbon atoms, especially 11 carbon atoms, approximately, on average, e.g. sodium and/or magnesium linear dodecyl benzene sulfonate. The sodium salt anionic is generally considered to be a milder detergent than the magnesium salt but is less effective for greasy soil removal and is also less effective in generating foam, especially in the presence of soil. However, when used in combination with APG, AEOS-1 to 2 EO, and alkanolamide foam stabilizer, satisfactory foam generation, grease removal and mildness can be simultaneously exhibited.

On the other hand, enhanced grease removal performance can be achieved with the Mg salt anionic. However, since the level of Mg ion can be lowered for any particular level of grease removal performance, it is still possible to achieve levels of mildness which are acceptable to the consumer. This appears to be especially so, in terms of perceived mildness effects, reported by small test panels of consumers, in compositions also containing the below described sulfosuccinate or sulfosuccinamate anionic surfactants.

(2) In accordance with one embodiment of the invention, a mono-alkyl $C_8$–$C_{18}$ sulfosuccinate or sulfosuccinamate anionic surfactant may be incorporated in the compositions of this invention, especially when the magnesium salt of ABS is used as, or as part of, component (1).

It is disclosed in U.S. Pat. No. 4,839,098 to Wisotski, et al to incorporate in an APG (alkyl of $C_{10}$–$C_{18}$, D.P.=1 to 5) containing liquid dishwashing detergent composition from 10 to 80 parts by weight of a $C_7$–$C_9$ dialkyl sulfosuccinate, based on a total surfactant content of 15 to 50% by weight, to enhance foaming and cleaning power. This patent suggests that such compositions should be free from petroleum-based anionic surfactants, such as alkyl benzene sulfonates and alkane sulfonates. However, other anionic surfactants such as alkyl ether sulfate or alkyl sulfate may replace a portion of the APG or dialkyl sulfosuccinate. The di($C_7$–$C_9$) alkyl sulfosuccinate are not considered to be mild surfactants and can contribute to harshness or irritation to the consumer.

In the compositions of this invention, the sulfosuccinate or sulfosuccinamate is present as the monoalkylsuccinate (MAS) or monoalkylsulfosuccinamate (MASA)

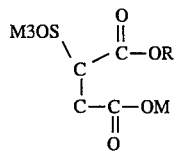

(MAS)

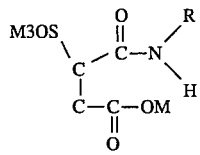

(MASA)

where R is an aliphatic radical, preferably alkyl, of from 10 to 18 carbon atoms, especially from 12 to 16 carbon atoms, and preferably lauryl ($C_{12}$), and M is a cation, such as an alkali metal, e.g. sodium or potassium, preferably sodium, ammonium, alkanolamine, e.g. ethanolamine, or magnesium. The alkyl radical may be ethoxylated with up to about 8 moles, preferably up to about 6 moles, on average, e.g. 2, 3, or 4 moles, of ethylene oxide, per mole of alkyl group.

Minor amounts, e.g. up to about 5% of dialkyl sulfosuccinates may be present with the monoalkyl sulfosuccinate or monoalkyl sulfosuccinamate. The mono-alkyl ester substantially free of dialkyl ester, and especially sodium monolauryl ester which may be ethoxylated with up to 4 moles of ethylene oxide and the mono- $C_{16}$ alkyl sulfosuccinamate monoethanolamine salt are preferred.

When present, the sulfosuccinate or sulfosuccinamate, anionic surfactant is used in amounts ranging from about 2 to 20% by weight, preferably from about 3 to 15% by weight, based on the total surfactants (A)(1)–(4). Based on the total composition, the preferred amounts of the sulfosuccinate anionic surfactant ranges from about 0.5 to 8 wt. %, more preferably 0.8 to 7 wt. %.

(3) The compositions of this invention also include an anionic alkyl ether sulfate (also commonly referred to as fatty alcohol ether ethyleneoxy sulfate AEOS nEO where n represents the number of moles, on average, of ethylene oxide (EO)) containing from about 10 to 20 carbon atoms in the alkyl moiety, preferably from about 12 to 14 or 16 carbon atoms and from 1 to less than 3 moles, preferably 1 to 2 moles, especially 1 mole, ethylene oxide, on average, per mole of the alkyl sulfate. The alkyl ether sulfate, which may be represented by the formula $R(OC_2H_4)_nOSO_3M$, where R is the residue of a fatty alcohol of from about 10 to 20 carbon atoms, n is a number of from 1 to less than 3, and M is a cation, is usually present as the alkali metal salt, especially the sodium salt, but may also be present as the potassium salt, ammonium salt, alkanolamine salt or magnesium salt.

The amount of the alkyl ether sulfate will usually be in the range of from about 32 to about 50% by weight, preferably from about 34 to 48% by weight, based on the total weight of surfactants (A)(1)–(4) or from about 8 to 20%, preferably 9 to 18%, and more preferably 10 to 16% by weight of the total composition.

(4) Another essential surfactant in the invention composition is (4) an alkyl glucoside, preferably an alkyl poly-glucoside, although alkyl monoglucoside may also be used.

The alkyl mono- and polysaccharides have received much attention recently for their beneficial detergent, foaming and viscosity modifying properties. Examples of patent literature relating to light duty liquid compositions containing alkyl monosaccharides include U.S. Pat. Nos. 4,732,704 and 4,732,696. The alkyl polysaccharides are used in the liquid detergent compositions disclosed, for example, in U.S. Pat. Nos. 4,396,520; 4,536,318; 4,565,647; 4,599,177; 4,663,069 and 4,668,422 (including monoglucosides), as well as many of the patents and literature cited in these patents.

In the present invention, a narrow subgenus of the alkyl saccharides has been found to effectively enhance grease removal with acceptable mildness when used in combination with the other surfactants (A)(1)–(3) and the foam stabilizer (B).

The alkyl ether type glycosides used in this invention are those having an alkyl group of from 12 to 16 carbon atoms, on average, and a glucoside hydrophilic group containing from about 1 to about 3, preferably from about 1.2 to about 3, and most preferably from about 1.3 to 2.7, glucoside units, such as 1.3, 1.4, 1.5, 1.6, 2.0 or 2.6 glucoside units. Of course, the number of glucoside units in any particular surfactant molecule will be a whole number (i.e. an integer), however, for any actual physical sample of alkyl glucoside surfactants there will, in general, be a range of glucoside units, and it is the average value which characterizes a particular surfactant product. The alkyl glycosides with lower D.P. values tend to provide more copious foaming whereas those with higher D.P. values tend to be more soluble, for the same alkyl chain length. If the alkyl group contains less than 12 carbon atoms, satisfactory mildness is difficult to achieve.

The alkyl group is preferably attached at the 1-position of the sugar molecule, but may be attached at the 1-, 3- or 4-positions, thus giving a glucosyl rather than a glucoside. Furthermore, in the polyglucosides, the additional glucoside units are predominantly attached to the previous glucoside at the 2-position, but attachment at the 3-, 4- and 6-positions can also occur.

Optionally, and less desirably, there may be a polyalkylene oxide chain (e.g. polyethylene oxide) joining the alkyl moiety and the glucoside units).

The preferred alkyl ether type glucosides have the formula:

$$R^2O(C_mH_{2m}O)_t(Z)_x$$

wherein Z is derived from glucose, $R^2$ is an alkyl group containing from 12 to about 16 carbon atoms, m is 2 or 3, preferably 2, t is from 0 to about 6, preferably 0, and x is from 1 to 3 (on average), preferably from 1.2 to 3, most preferably from 1.3 to 2.7. To prepare these compounds a long chain alcohol ($R^2OH$) can be reacted with glucose, in the presence of an acid catalyst to form the desired glucoside. Alternatively the alkyl polyglucosides can be prepared by a two step procedure in which a short chain alcohol ($C_1$–$C_6$) is reacted with glucose or a polyglucoside (x=2 to 3) to yield a short chain alkyl glucoside (x=1 to 3) which can in turn be reacted with a longer chain alcohol ($R^2OH$) to displace the short chain alcohol and obtain the desired alkyl glucoside. If this two step procedure is used, the short chain alkyl glucoside content of the final alkyl glucoside material should be less than 50%, preferably less than 10%, more preferably less than 5%, most preferably 0% of the alkyl glucoside.

The amount of unreacted alcohol (the free fatty alcohol content) in the desired alkyl polyglucoside surfactant is preferably less than about 2%, more preferably less than about 0.5% by weight of the total of the alkyl polyglucoside plus unreacted alcohol. The amount of alkyl monoglucoside, if present, is preferably no more than about 40%, more preferably no more than about 20% by weight of the total of the alkyl polyglucoside. For some uses it is desirable to have the alkyl monoglucoside content less than about 10%, especially less than about 5%.

The amount of the alkyl ether type glucoside surfactant to achieve the desired foam and detersive properties is in the range of from about 14 to 32%, preferably from about 16 to 30%, based on the sum of the surfactants (A)( 1 ), (2), (3) and (4). The preferred amounts range from 3 to 12%, especially from 4 or 5 to 10%, based on the total composition.

Within these ranges the relative amounts of the alkyl benzene sulfonate (ABS) surfactant and alkyl glucoside (APG) surfactant is not particularly critical, but will generally be within the range of ABS:APG of from about 2.5:1 to 1:2, preferably from about 2:1 to 1:1.2.

In the invention compositions, the total amount of active surfactant components (A) plus (B) will be in the range of from about 25% to 54% of the total composition, preferably from about 28 to 50%, more preferably from about 28% to 42%, such as 30%, 32%, 34%, 35% or 40%.

(B) Foam Stabilization System

The foam stabilization system which may also itself contribute to the foaming capacity as well as foam stabilizing effect is comprised of the lower alkanolamide of higher alkanoic acid which is the reaction product of a lower alkanol of 2 to 3 carbon atoms and an alkanoic acid of 10 to 16 carbon atoms, preferably with 80% or more of the lower alkanol being ethanol and a similar proportion of the alkanoic acid being of 12 to 14 carbon atoms. Other lower alkanols that are also useful are n-propanol and isopropanol. The preferred alkanoic acid is a mixture of lauric and myristic acids, generally in proportions of 1:2 to 2:1, with about 50% of each being preferable. Alternatively, coconut oil or hydrogenated coconut oil may be used as a source of the alkanoic acids. Suitable alkanoic acid alkanolamides include the monoethanolamides, diethanolamides and the monoisopropanolamides.

Specific examples include mixed lauric/myristic diethanolamide, lauric/myristic monoethanolamide, lauric monoethanolamide, lauric diethanolamide, coco diethanolamide, coco monoethanolamide, and the like.

The amount of the alkanoic acid alkanolamide may be up to about 6% of the composition, such as 0.5 to 6%, preferably 1 to 5%, more preferably 1 to 4%, such as 1.5, 2, 3 or 4%, of the composition.

The compositions of this invention which include the salt surfactants (A)(1), (A)(3), (A)(4) and, optionally, (A)(2) and foam stabilization system (B), in the specified proportions, as essential ingredients are formulated in an aqueous carrier to provide mild, stable foaming liquid compositions especially effective in cleaning, by hand washing, dishware, such as dishes, glasses, flatware, pots, pans, etc., at ambient wash water temperature, as well, of course, at warm or hot wash water temperatures. The invention formulations are mild to the hands and are clear and homogenous. Clarity and homogeneity may often, however, be improved by inclusion of, for example, organic solvents and/or hydrotropes, and these and other optional additives may also be included in the compositions in amounts which do not adversely influence the desirable properties.

(C) Organic Solvent

Cosmetically acceptable organic solvents, usually lower alcohols, such as ethanol, propanol, isopropanol, propylene glycol, or mixtures thereof, may be included in the composition for its thinning effect, lowering of clear point, and for its solubilizing effect for any components which may not be readily soluble in the main aqueous medium. The amount of solvent, when present, will usually be limited to about 10%, preferably 8%, especially no more than about 6% of the composition, such as from 2 to 5%. Ethanol is the preferred organic solvent.

(D) Hydrotrope

In order to assist in solubilizing various components of the composition, maintain a low clear point, and possibly modify viscosity, it is customary to include a hydrotropic substance in the composition. Typical hydrotropes include primarily urea and the lower alkyl aryl sulfonate salts, such as sodium xylene sulfonate, potassium xylene sulfonate, sodium cumene sulfonate, ammonium xylene sulfonate, and the like. Mixtures of two or more hydrotropes may also be used. The hydrotrope, when used, is generally present in amounts below about 8%, preferably below about 6%, such as from 1 or 2 to 6%.

(E) Other Optional Functional and Aesthetic Additives

Various other materials may also be included in the present compositions for their desirable functional or aesthetic effects. Among these, those materials employed to increase the mildness of the detergent composition to the human hands, such as the water soluble proteins, are often very useful.

Although solvents, including water, tend to make the products clear liquids, it is sometimes desirable to opacify them or make them appear pearly. For such purpose there may be employed opacifying agents, e.g. behenic acid, or a pearlescent or pearlizing composition, such as an approximately equal mixture of high fatty acid ester of polyethoxy ethanol, coconut oil fatty acid alkanolamide and sodium lauryl ether sulfate. The higher fatty acid will usually be of 10 to 18 carbon atoms and the polyethoxy content will be of 1 to 20, preferably 1 to 10 ethoxy groups. The alkanolamide will preferably be ethanolamide, but can be mixed with isopropanolamide, too.

Additional adjuvant components of the present compositions include perfumes; sequestrants, e.g. monohydrogen ethylene diamine tetraacetate, tetrasodium ethylene diamine tetraacetate, trisodium nitrilotriacetate; bactericides, e.g. trichlorocarbanilide, tetrachlorosalicylanilide, hexachlorophene, chlorobromosalicylanilide; antioxidants; thickeners, e.g. sodium carboxymethyl cellulose, polyacrylamide, Irish moss; dyes; water dispersible pigments; salts, e.g. sodium sulfate, magnesium sulfate, as the heptahydrate or anhydrous, sodium chloride; preservatives, such as formaldehyde or hydrogen peroxide, pH modifiers, etc.

The total amount of the additional additives is usually no more than about 20% of the composition, preferably not exceeding 15%, while the amount of any individual ingredient will not generally exceed 10%, especially 5%, and usually no more than 2 or 3%.

In the above description of the compositions of this invention and the various adjuvants employable therein, and in the claims, although individual constituents are mentioned for various classes or types of components it is within the invention that mixtures thereof be employed, such as mixtures of two or three anionic detergents or mixtures with the nonionic detergents, both possibly with other anionic and nonionic detergents known in the art, mixtures of skin treating materials and mixtures of solvents, among others.

For example, under certain circumstances paraffin sulfonate surfactants, such as sodium or magnesium ($C_{12}$–$C_{18}$) paraffin sulfonate, can be used to replace part or all of the ABS surfactant, achieve good foam and grease removal characteristics. Amphoteric surfactants, such as the betaines, e.g. acylamidopropyl dimethyl ammonium betaines, can also often provide improvements in overall performance.

The viscosities of the detergent compositions may be further varied by the addition of thickening agents, such as gums and cellulose derivatives. The product viscosity and flow properties should be such as to make it pourable from a bottle and not so thin as to tend to splash or pour too readily, since usually only small quantities of the liquid detergent are to be utilized in use. Viscosities from 20 to 1000 centipoise (Brookfield Viscometer spindle No. 1,12 rpm) are found useful with those from 100 to 500 cps being preferred and a viscosity of about 200 centipoise being considered best by most consumers, although at somewhat lower viscosities, e.g. 100 cps, consumer acceptance is almost the same.

In manufacturing the described formulations, usually it is preferred to heat the detergent constituents to a somewhat elevated temperature, e.g. 40° to 50° C. and then admix them with the water and, optionally, all or a portion of the ethanol. Thereafter, other anionic and nonionic detergents, urea, amide, protein and other adjuvants are added with the more voltaile materials, such as perfumes, preferably being added last and after cooling of the composition to about room temperature. Normally when making opaque or pearlescent detergents, the pearlizing mixture will also be added near last at about room temperature. Although the described method of making the compositions is preferred, various other known techniques may also be employed, depending upon the particular detergent composition.

The pH of the formulation will generally be near neutral, e.g. about 5 to 8, preferably about 6.5 to 7.5.

The instant light duty liquid detergents preferably contain about 0 to 0.35 wt. %, more preferably about 0.1 to 0.3 wt. %, more preferably about 0.13 to 0.25 wt. percent of trichlorohydroxydiphenyl ether antimicrobial agent. In addition, the light duty liquid detergent composition can optionally contain 0 to about 0.5 wt. %, more preferably about 0.05 to about 0.3 of a second antimicrobial agent selected from the group consisting of Formalin, Glydant Plus, Kathon which is 5-chloro-2-methyl-4-isothiazoline-3-one and Dowicil 75 which is 67.5 wt. % of 1-(3-chloroalkyl)-3,5,7-trazal-azoniaadamantane chloride and 32.5 wt. % of sodium bicarbonate.

The present invention relates to a liquid dishwashing detergent composition providing stable foaming characteristics and which is mild to the hands and is effective in removing greasy soils, said composition by weight comprising:

(a) A surfactant system comprising:

(1) from about 7.5 to 20% of a salt of a $C_{10}$–$C_{16}$ linear alkyl benzene sulfonate anionic surfactant, said salt being selected from the group consisting of alkali metal salts, alkaline earth metal salts and mixtures thereof;

(2) from 0.5 to about 8% of anionic $C_{10}$–$C_{18}$ alkyl sulfosuccinate or sulfosuccinamate, wherein the alkyl group may be ethoxylated with up to 8 moles of ethylene oxide;

(3) from about 8 to 20% of anionic $C_{10}$–$C_{20}$ alkyl ether sulfate having from 1 to less than 3 moles ethylene oxide per mole of alkyl group; and (4) from about 3 to 12% by weight of an alkyl polyglucoside having from 12 to 16 carbon atoms, on average, in the alkyl chain, and an average degree of polymerization in the range of from about 1 to about 3;

(b) from about 0.5 to about 6%, more preferably 1 to 5% by weight of a foam stabilization system comprising at least one lower alkanolamide of higher alkanoic acid; the total weight of components (a) and (b) ranging from about 25 to 54% by weight of the composition;

(c) up to about 10%, more preferably 2 to 5% of a low irritant organic solvent;

(d) up to about 8% more preferably 1 to 6% of hydrotrope;

(e) about 0.1 to about 0.3% of trichlorohydroxy diphenyl ether;

(f) up to about 20% more preferably up to 10% in total of one or more optional additives chosen from chelating or sequestering agents, coloring agents, perfumes, bactericides, fungicides, preservatives, sunscreening agents, pH buffering agents, opacifiers, thickeners, and proteins; and (g) the balance being water.

The preferred composition has a surfactant system (A) comprising:

(1) from about 8 to 15% of a $C_{10}$–$C_{14}$ alkyl benzene sulfonate;

(2) 0.5 to about 8% of sodium salt of $C_{10}$–$C_{14}$ mono-alkyl sulfosuccinate or sulfosuccinamate;

(3) 10 to 16% of sodium salt of $C_{10}$–$C_{14}$ alkyl ether sulfate having from 1 to 2 moles ethylene oxide; and (4) from about 4 to 10% of an alkyl polyglucoside having from about 12 to 16 carbon atoms in the alkyl group and from about 1.2 to 3 glucoside units.

In the composition the foam stabilization system (B) comprises at least one compound selected from the group consisting of lauric diethanolamide, lauric monoethanolamide, myristic diethanolamide, myristic monoethanolamide, coco diethanolamide, and coco monoethanolamide wherein the foam stabilization system (B) comprises from about 1 to 5% of the composition.

A more preferred composition comprises:

(a) a surfactant system comprising:

(1) about 9 to about 11% of sodium dodecyl benzene sulfonate;

(2) 0.5 to about 2% sodium $C_{10}$–$C_{14}$ mono-alkyl sulfosuccinate or sulfosuccinamate, the alkyl group of which may be ethoxylated with up to 6 moles of ethylene oxide;

(3) about 10 to about 16% $C_{10}$–$C_{16}$ alkyl ether sulfate having from 1 to 2 ethylene oxide groups; and (4) about 4 to about 10% of said alkyl ether type polyglucoside;

(b) 1 to 3% of said foam stabilization system comprising lauric/myristic monoethanolamide;

(c) 2 to 10% ethanol;

(d) 1 to 6% of sodium xylene sulfonate, sodium cumene sulfonate or mixtures thereof;

(e) 0.5 to 5% in total of one or more of magnesium sulfate, sodium chloride, color and fragrance; and (f) the balance being water.

A still more preferred composition comprises a surfactant system comprising:

(1) about 9 to about 11% of magnesium $C_{10}$–$C_{12}$ alkyl benzene sulfonate;

(2) about 0.8 to about 7% of $C_{10}$–$C_{16}$ monoalkyl sulfosuccinate or sulfosuccinamate, wherein the alkyl group may be ethoxylated with up to 5 moles ethylene oxide;

(3) about 8 to about 14% of $C_{10}$–$C_{16}$ alkyl ether sulfate, ethoxylated with from 1 to 2 moles ethylene oxide, and (4) about 4 to about 8% of an alkyl ether type polyglucoside;

(b) 1 to 3% of said foam stabilization system comprising lauric/myristic monoethanolamide;

(c) 4 to 10% of sodium xylene sulfonate, sodium cumene sulfonate or mixtures thereof;

(d) 0.5 to 5% in total of one or more of magnesium sulfate, sodium chloride, color and fragrance; and (e) the balance being water.

The following representative non-limiting examples will help to further understand the present invention.

EXAMPLE 1

The following compositions L and L' were prepared:

| Component | L Active Ingredients (wt. %) | L' Active Ingredients (wt. %) |
|---|---|---|
| Mg linear dodecyl benzene sulfonate ([Mg(LDBS)2]11.5 | 9.6 | 9.6 |
| Alkyl ether type polyglycoside[1] | 6.0 | 6.0 |
| C12–C16 alkyl ether sulfate (1EO) | 11.8 | 11.8 |
| Lauric/myristic monoethanolamide (LMMEA)/Sodium Xylene Sulfonate(SXS) (5:3 blend) | 2.0[2] | 2.0[2] |
| Ethanol (3A) | 4.1 | 4.1 |
| Sodium cumene sulfonate (SCS) | 2.1 | 2.1 |

-continued

| Component | L Active Ingredients (wt. %) | L' Active Ingredients (wt. %) |
|---|---|---|
| Disodium lauryl sulfosuccinate (Minarol LSS) | 4.6 | |
| Disodium laureth (3EO) sulfosuccinate | | 1.5 |
| MgSO4.7H2O | 1.0 | 1.0 |
| Monohydrogen ethylene diamine tetraacetate, trisodium salt (HEDTA) | 0.1 | 0.1 |
| NaCl | 2.0 | 2.0 |
| Perfume | 0.4 | 0.4 |
| Color | 0.1 | 0.1 |
| Water, deionized | qs | qs |

[1]APG 625 from Henkel Corp., hydrophobe chain length of C12/C14/C16 = 68/26/6, average of 1.6 glycoside units.
[2]Based on LMMEA; SXS = 1.2 wt. %

EXAMPLE 2

The following compositions WJ' and WJ" were prepared:

| | WJ' Active Ingredient (wt. %) | WJ" Active Ingredient (wt. %) |
|---|---|---|
| Na (LDBS) | 10.0 | 10.0 |
| APG 625 | 9.0 | 6.0 |
| C12–C16 alkyl ether sulfate (1EO) | 11.8 | 11.8 |
| LMMEA/SXS (5:3) | 1.6[1] | 4.0[1] |
| AEOS-1EO | 14.0 | 14.0 |
| Ethanol (3A) | 0.5 | 0.5 |
| SCS | 0.9 | 0.9 |
| MgSO4.7H2O | 1.0 | 1.0 |
| NaCl | 1.0 | 1.0 |
| HEDTA | 0.1 | 0.1 |
| Perfume | 0.3 | 0.3 |
| Colorant | 0.1 | 0.1 |
| Water, deionized | qs to 100 | qs to 100 |

[1]Based on LMMEA

EXAMPLE 3

Compositions A–E were prepared in the same manner as compositions WJ' and WJ" except that the amounts of APG-625 and LMMEA were changed as follows:

| | A | B | C (wt. %) | D | E |
|---|---|---|---|---|---|
| APG-625 | 10.0 | 5.0 | 10.0 | 5.0 | 7.5 |
| LMMEA | 4.0 | 1.0 | 1.0 | 4.0 | 2.5 |

The compositions from Examples II and III were tested in the Shake-Foam Test, Shell Foam Test and Baumgartner grease (lard) removal test as described below.

(1) Baumgartner Gravimetric Grease Removal Test

This test measures the ability of a diluted (1%) solution in 150 ppm hardness water to remove a greasy soil (lard) from a test surface (a cleaned glass slide 2.5 cm × 0.1 cm). The soil is applied by spreading about 0.2 to about 0.3 grams lard onto each cleaned glass slide. The soiled slides are cleaned in a 1% product solution by dipping the soiled slide into the solution 600 times. The solution is maintained at ambient temperature (75° F.). After washing, the slides are dried in a desiccator for two hours. The difference in weight of the lard before and after the cleaning process is taken as a measure of grease removal, the greater the difference the more effective is the detergent composition.

(2) Shake-Foam Test 100 ml of a diluted (1%) test solution in 150 ppm hardness water (113° F.) is filled into a 500 ml graduated cylinder with a stopper. The stopped cylinder is placed on an agitating machine which rotates the cylinder for 20 cycles at 30 rpm. The height of the foam in the cylinder is observed. A sugar cube having absorbed thereon 0.01+0.001 grams of a mixed soil (potato buds, Crisco®, milk, olive oil and water) is then added to the cylinder and the test repeated. This procedure is continued until a total of 0.03 grams of soil have been added.

(3) Shell-Foam Test

An 0.04% concentration of the test solution in 250 ml of water (150 ppm hardness, 45° C.) is filled into a water jacketed vessel with baffles and having a constant speed agitation (300 rpm mixing). Stirring is continued until the generated foam covers the entire surface of the test solution. A mixed soil (olive oil, milk, Crisco®, and potato buds) is slowly injected at a constant rate sufficient to uniformly disperse the soil below the surface of the solution. The soil interacts first with the surfactant in the solution until the surfactant is depleted and thereafter begins to deplete surfactant from the foam. The amount of soil (in grams) added until the foam quickly collapses is determined. The results (end point) are reported in Table 2 in grams.

Each of these tests were performed in triplicate and the reported results represent the average of the three tests.

The results of the tests are shown in Table 2.

TABLE 2

| Comp | Total Surfactants and LMMEA (wt. %) Wt. ratio APG/LMMEA | Shake-Foam Volume, ml. no soil | 0.01 soil | 0.02 soil | 0.03 soil | Shell-Foam soil wt., g to EP | Grease mg soil removed |
|---|---|---|---|---|---|---|---|
| A | 38 (10/4) | 403 | 337 | 273 | 217 | 10.9 | 79 |

TABLE 2-continued

| Comp | Total Surfactants and LMMEA (wt. %) Wt. ratio APG/LMMEA | Shake-Foam Volume, ml. no soil | 0.01 soil | 0.02 soil | 0.03 soil | Shell-Foam soil wt., g to EP | Grease mg soil removed |
|---|---|---|---|---|---|---|---|
| B | 30 (5/1) | 418 | 340 | 290 | 242 | 6.7 | 3 |
| C | 35 (10/1) | 417 | 335 | 287 | 235 | 9.6 | 7 |
| D | 33 (5/4) | 393 | 317 | 252 | 193 | 9.9 | 91 |
| E | 34 (7.5/2.5) | 430 | 353 | 315 | 268 | 10.6 | 40 |
| WJ' | 34.6 (9/1.6) | | | | | | 15 |
| WJ" | 34 (6/4) | | | | | | 98 |
| L | 34.0 (6/2) | | | | | | 87 |
| L' | 30.9 (6/2) | | | | | | 87 |

Note: Formulas A-WJ" have 10 LAS And 14 AEOS-1EO; Formulas L and L' contain 9.6 LAS and 11.8 AEOS-1EO; tests conducted in 150 ppm water. Total surfactants = (A)(1) and (A)(2) and (A)(3) and (A)(4) and (B).

Both compositions WJ' and L had excellent rinsing characteristics as compared to Liquid Palmolive® and a commercial product containing a high level of magnesium for grease removal, but which is not believed to include any alkyl polyglucoside.

The above formulas A–E were statistically analyzed to identify main and interaction effects of LMMEA and APG on grease removal. Only LMMEA level was found to affect grease cleaning performance. All other formula factors (surfactants) did not significantly affect grease removal. Compositions And D, having 4% LMMEA, removed a high level of grease versus regular Liquid Palmolive® which would remove 25 to 30 mg of soil. For reference, another leading commercial product containing a high level of magnesium for grease removal effectiveness would remove 120 mg of soil. However, it is significantly more irritating than Liquid Palmolive® in a clinical handsoak test. The L and L' formulas also contain higher Mg levels and also remove more grease. These formulas are clinically milder than the commercial high Mg product. The product WJ" containing 6% APG and 4% LMMEA, which provided comparable grease removal performance to formulas A and D was clinically tested and found to be as mild as Liquid Palmolive®.

Compositions WJ' and WJ" were both evaluated to have equal mildness to Liquid Palmolive® and superior mildness to the high Mg-containing commercial product.

While the representative composition WJ' (NaLAS) was not as effective as Liquid Palmolive® or the high Mg-containing commercial product in the standard Baumgartner grease (lard) removal test, it appears to be superior in terms of Crisco®-monoglyceride grease soil removal in a sample soaking test.

Similar compositions containing 17% LAS/13 AEOS-3EO with 0% APG and with 0% LMMEA or 4% LMMEA were tested in the grease removal test. The composition containing 0% LMMEA removed approximately 5 mg of soil while the composition with 4% LMMEA removed 25 mg of soil. This demonstrates the interaction of LMMEA with APG to produce the enhanced performance on grease.

EXAMPLE 4

In order to test the effect of the sulfosuccinate/sulfosuccinamate anionic surfactant in the composition L of Example 1, four different surfactants were tested at 0%, 1.5% and 3% sulfosuccinate/sulfosuccinamate levels in composition L and were compared to Liquid Palmolive (POL) in the Baumgartner grease removal and Shake-Foam tests described above. The surfactants which were tested were the sodium monolauryl sulfosuccinate used in L, the sodium monolauryl (3E) sulfosuccinate used in L' (laureth), sodium dioctyl sulfosuccinate, and mono-$C_{16}$ alkyl sulfosuccinamate, monoethanolamine salt (ris). All of these surfactants were obtained from Rhone Poulenc (France).

The results are shown in Table 3.

TABLE 3

| | (Lard Removal) Baumgartner | | Shake Foam Volume, mls | | | | | | | |
|---|---|---|---|---|---|---|---|---|---|---|
| | mgs | SD | Initial | SD | 0.1 soil | SD | 0.2 soil | SD | 0.3 soil | SD |
| POL (ref) | 37 | 11 | 385 | 10 | 330 | 30 | 260 | 15 | 195 | 15 |
| 0% Sulfosuccinate | 122 | 34 | 387 | 12 | 317 | 25 | 252 | 23 | 184 | 24 |
| 1.5% dioctyl | 160 | 8 | 365 | 0 | 305 | 5 | 240 | 15 | 195 | 15 |
| 3% dioctyl | 118 | 4 | 395 | 30 | 315 | 15 | 270 | 5 | 210 | 15 |
| 1.5% laureth | 126 | 25 | 390 | 5 | 315 | 5 | 255 | 20 | 185 | 25 |

TABLE 3-continued

| | (Lard Removal) Baumgartner | | Shake Foam Volume, mls | | | | | | | |
|---|---|---|---|---|---|---|---|---|---|---|
| | mgs | SD | Initial | SD | 0.1 soil | SD | 0.2 soil | SD | 0.3 soil | SD |
| 3% laureth | 104 | 48 | 380 | 10 | 340 | 10 | 270 | 15 | 215 | 15 |
| 1.5% lauryl | 117 | 28 | 380 | 10 | 295 | 15 | 260 | 5 | 215 | 10 |
| 3% lauryl | 134 | 16 | 405 | 5 | 340 | 20 | 290 | 25 | 235 | 20 |
| 1.5% ris | 144 | 6 | 390 | 10 | 320 | 10 | 280 | 15 | 210 | 10 |
| 3% ris | 110 | 20 | 375 | 10 | 325 | 10 | 275 | 20 | 225 | 25 |

Note: SD = Standard Deviation, based on three replicates.

Conclusions of Sulfosuccinate Performance Comparison Grease Performance

Grease cleaning results of the various sulfosuccinates tested at 0%, 1.5%, and 3% in the L formula (MgLAS) indicate all four sulfosuccinates produce a high and comparable level of grease removal performance at all levels tested.

Shake-Foam Performance

In general, there is a slight upward trend in foam volume at each level of soil addition as the sulfosuccinate increases from 0% to 3%. Performance is not considered to be significantly different unless a difference in foam volume greater than 50 mls is observed. The lowest to highest foam volume at each condition regardless of sulfoscuccinate type or level is typically within 50 ml. Therefore, based on minimal impact on foam volume, any of the four materials could be used. The more important factors are formula mildness and consumer acceptability.

The dioctyl sulfosuccinate is not believed to provide the same degree of mildness as the higher chain length alkyl esters.

EXAMPLE 5

The following light duty liquid detergent was prepared according to the procedure of Example 1.

| | A | B |
|---|---|---|
| C12–16 Alcohol EO 1.3:1 ammonium sulfate | 14.000 | 14.000 |
| Sodium dodecyl benzene sulfonate (linear | 5.342 | 5.342 |
| Magnesium dodecyl benzene sulfonate (linear) | 4.687 | 4.687 |
| APG 625 | 6.0 | 6.0 |
| Lauryl/Myristyl monoethanolamide/Sodium Xylene Sulfonate blend 5/3 | 5.385 | 5.385 |
| Magnesium sulfate heptahydrate | 1.00 | 1.00 |
| NaCl | 0.350 | 0.350 |
| Perfume | 0.250 | 0.250 |
| HEDTA Trisodium salt | 0.200 | 0.200 |
| Trichlorohydroxy diphenyl ether | 0.150 | |
| Dowicil 75 | 0.070 | 0.070 |
| Colorant | 0.004 | 0.004 |
| Formalin | 0.004 | 0.004 |
| Water | Balance | Balance |
| Brookfield viscosity #21 spindle 20 rpms, RT (cps) | 425 | 425 |
| Inhibition growth of *S. Aureus* organism (mean log CFU) | 2.56 | 0.46 |
| Inhibition growth of *E. Coli* organism (mean log CFU) | 2.04 | 0.61 |

What is claimed is

1. A liquid dishwashing detergent composition providing stable foaming characteristics and which is mild to the hands and is effective in removing greasy soils, said composition by weight comprising:

(a) a surfactant system comprising:

(1) from about 8 to 12% by weight of a salt of a $C_{10}$–$C_{14}$ linear alkyl benzene sulfonate anionic surfactant, said salt being selected from the group consisting of alkali metal salts, alkaline earth metal salts and mixtures thereof;

(2) from 0.5 to about 6% of anionic $C_{10}$–$C_{18}$ mono alkyl sulfosuccinamate, wherein the alkyl group may be ethoxylated with up to 8 moles of ethylene oxide, said monoalkyl succinamate having the structure:

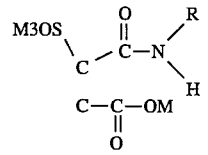

(MASA)

where R is an aliphatic radical, of from 10 to 18 carbon atoms, and M is a cation, selected from the group consisting of sodium, potassium, ammonium and alkanolamine (3) from about 10 to 16% of anionic $C_{10}$–$C_{20}$ alkyl ether sulfate having from 1 to 2 moles ethylene oxide per mole of alkyl group; and (4) from about 5 to 10% by weight of an alkyl ether type polyglucoside having from 12 to 16 carbon atoms, on average, in the alkyl chain, and an average degree of polymerization in the range of from about 1 to about 3;

(b) from 1 to 5% of a foam stabilization system comprising lauric/myristic monoethanolamide; the total weight of components (a) and (b) ranging from about 28 to 42% by weight of the composition;

(c) up to about 5% of ethanol;

(d) up to about 6% of hydrotrope;

(e) about 0 to about 0.35% of trichlorohydroxy diphenyl ether; and (f) up to about 20% in total of one or more optional additives selected from the group consisting of chelating or sequestering agents, coloring agents, perfumes, fungicides, preservatives, sunscreening agents, pH buffering agents, opacifiers, thickeners, and proteins; and (g) the balance being water.

2. The composition of claim 1 which comprises:

(a) a surfactant system comprising:

(1) about 9 to about 11% of sodium dodecyl benzene sulfonate;

(2) 0.5 to about 2% sodium $C_{10}$–$C_{14}$ mono-alkyl sulfosuccinate or sulfosuccinamate, the alkyl group of which may be ethoxylated with up to 6 moles of ethylene oxide;

(3) about 10 to about 16% $C_{10}$–$C_{16}$ alkyl ether sulfate having from 1 to 2 ethylene oxide groups; and (4) about 4 to about 10% of said alkyl ether type polyglucoside;

(b) 1 to 3% of said foam stabilization system comprising lauric/myristic monoethanolamide;

(c) 2 to 10% ethanol;

(d) 1 to 6% of sodium xylene sulfonate, sodium cumene sulfonate or mixtures thereof;

(e) 0.5 to 5% in total of one or more of magnesium sulfate, sodium chloride, color and fragrance; and (f) the balance being water.

3. The composition of claim 1 comprising:

(a) a surfactant system comprising:

(1) about 9 to about 11% of magnesium $C_{10}$–$C_{12}$ alkyl benzene sulfonate;

(2) about 0.8 to about 7% of $C_{10}$–$C_{16}$ monoalkyl sulfosuccinamate, wherein the alkyl group may be ethoxylated with up to 5 moles ethylene oxide;

(3) 10 to 16% of $C_{10}$–$C_{16}$ alkyl ether sulfate, ethoxylated with from 1 to 2 moles ethylene oxide, and (4) about 4 to about 8% of said alkyl ether type polyglucoside;

(b) 1 to 3% of said foam stabilization system comprising lauric/myristic monoethanolamide;

(d) 4 to 10% of sodium xylene sulfonate, sodium cumene sulfonate or mixtures thereof;

(f) 0.5 to 5% in total of one or more of magnesium sulfate, sodium chloride, color and fragrance; and (g) the balance being water.

4. The composition of claim 1 wherein the surfactant system a comprises, based on the total surfactant system (a), (1) 28 to 40% by weight of the $C_{10}$ to $C_{16}$ alkyl benzene sulfonate;

(2) 3 to 15% by weight of the mono-alkyl sulfosuccinamate;

(3) 32 to 50% by weight of the alkyl ether sulfate; and (4) 14 to 32% of the alkyl ether type polyglucoside.

5. The composition of claim [2] 1 wherein the surfactant system (a) comprises, based on the total amount of the surfactant system (a), (1) 29 to 35% of $C_{10}$ to $C_{14}$ alkyl benzene sulfonate;

(2) 3 to 15% of sodium salt of $C_{10}$ to $C_{14}$ mono-alkyl sulfosuccinamate;

(3) 34 to 48% of sodium salt of $C_{10}$ to $C_{14}$ alkyl ether sulfate having 1 to 2 moles ethylene oxide; and (4) 16 to 30% of alkyl polyglucoside having from about 12 to 16 carbon atoms in the alkyl group and from about 1.2 to 3 glucoside units.

6. The composition of claim 3 wherein the surfactant system (a) and foam stabilization system (B) (b) together comprise from about 28 to 42% by weight of the composition.

* * * * *